US006953915B2

(12) United States Patent
Garris, III

(10) Patent No.: US 6,953,915 B2
(45) Date of Patent: Oct. 11, 2005

(54) SWITCHING SYSTEM FOR PLURAL SIMMER VOLTAGES

(75) Inventor: Charles A. Garris, III, Vienna, VA (US)

(73) Assignee: Robertshaw Controls Company, Richmond, VA (US)

( * ) Notice: Subject to any disclaimer, the term of this patent is extended or adjusted under 35 U.S.C. 154(b) by 556 days.

(21) Appl. No.: 10/058,350

(22) Filed: Jan. 30, 2002

(65) Prior Publication Data

US 2002/0158617 A1 Oct. 31, 2002

Related U.S. Application Data

(60) Provisional application No. 60/265,558, filed on Jan. 31, 2001.

(51) Int. Cl.[7] ..... H05B 1/02

(52) U.S. Cl. ..... 219/482; 200/569; 337/10; 307/75

(58) Field of Search ..... 200/6 B, 6 BB, 200/6 R, 7, 17 R, 38 B, 574, 573, 33 B–33 D, 564, 568, 569; 337/1, 8, 10, 11; 307/75; 219/482, 488, 489, 492

(56) References Cited

U.S. PATENT DOCUMENTS

| | | | | |
|---|---|---|---|---|
| 2,623,137 A | | 12/1952 | Vogelsberg | |
| 2,838,646 A | * | 6/1958 | Welch | 219/489 |
| 2,870,290 A | | 1/1959 | Taylor et al. | |
| 3,634,802 A | | 1/1972 | Aldous | |
| 3,636,490 A | | 1/1972 | Pansing | |
| 3,691,404 A | * | 9/1972 | Swygert, Jr. | 327/423 |
| 3,846,726 A | | 11/1974 | Hierholzer, Jr. et al. | |
| 3,905,003 A | | 9/1975 | Rosenberg et al. | |
| 3,932,830 A | | 1/1976 | Holtkamp | |
| 3,975,601 A | * | 8/1976 | Whelan | 200/11 R |
| 4,133,990 A | * | 1/1979 | Wanner et al. | 200/6 B |
| 4,206,344 A | | 6/1980 | Fischer et al. | |
| 4,337,451 A | | 6/1982 | Fox | |
| 4,495,387 A | * | 1/1985 | Thrush | 200/6 B |
| 4,704,595 A | | 11/1987 | Essig et al. | |
| 4,883,983 A | | 11/1989 | Llewellyn et al. | |
| 4,949,020 A | * | 8/1990 | Warren et al. | 315/297 |
| 4,993,144 A | | 2/1991 | Llewellyn et al. | |
| 5,021,762 A | | 6/1991 | Hetrick | |
| 5,219,070 A | * | 6/1993 | Grunert et al. | 200/330 |
| 5,636,618 A | * | 6/1997 | Kirstein | 123/564 |
| 5,700,994 A | * | 12/1997 | Gheer et al. | 219/492 |
| 6,008,608 A | * | 12/1999 | Holsten et al. | 200/573 |
| 6,078,169 A | * | 6/2000 | Petersen | 323/273 |

FOREIGN PATENT DOCUMENTS

| | | | |
|---|---|---|---|
| DE | 2356500 | * | 5/1975 |
| DE | 2364832 | * | 7/1975 |

* cited by examiner

*Primary Examiner*—Teresa J. Walberg
(74) *Attorney, Agent, or Firm*—Reinhart Boerner Van Deuren P.C.

(57) ABSTRACT

A combination selector switch and infinite switch energy regulator provides a plurality of simmer voltages. An infinite switch energy regulator for adapting input voltage level to an average output voltage level is provided. This energy regulator has a rotatable shaft for adjusting the average output voltage level. An input voltage selector, such as an F switch, selects between a plurality of input voltages by actuation of a rotatable cam. The output of the input voltage selector is provided as an input to the infinite switch. The rotatable shaft is also operatively coupled to the rotatable cam and thus controls the input voltage selector as well as the infinite switch. The selective provision of two different voltage levels as an input to the infinite switch permits a plurality of simmer voltages when the unit is assembled in an electric range.

20 Claims, 6 Drawing Sheets

SWITCHING SYSTEM FOR PLURAL SIMMER VOLTAGES

RELATED APPLICATIONS

This application claims priority from Provisional Application Ser. No. 60/265,558, filed Jan. 31, 2001, the entire disclosure of which is hereby incorporated by reference herein.

FIELD OF THE INVENTION

The present invention relates to a combination selector switch and infinite switch energy regulator unit, and more particularly, to a combined unit that employs a single actuator to control the duty cycle produced by an infinite switch energy regulator that is selectively supplied with one of multiple voltages by the selector switch.

BACKGROUND OF THE INVENTION

The use of infinite switch energy regulators are well known in the art of energy and load control. For example, infinite switch energy regulators are employed in electric ranges, to control the energy supplied to a load, such as a burner. In a typical infinite switch energy regulator, depending on the setting of the switch, a duty cycle is selected to be provided as an output from the energy regulator to the load. An infinite switching type energy regulator works on the principle that if the contacts are opened and closed at different on-to-off time ratios, or different duty cycles, sometimes referred to as % (percent) on-times, the energy transmitted to a physical mass, through an electrical load, can be regulated as those ratios are varied. However, in order to regulate the temperature of the heating element to which the electrical power is supplied, the on/off switching of electrical energy requires that the cooktop heating element (load) and physical mass in contact with the heating element, such as a pot or pan with water or food, have a significant lumped thermal capacitance.

An infinite switching type energy regulator typically has a bimetal coupled to a cycling contact and an internal heater that causes the bimetal to deform when energy is applied to the internal heater and the resistive load. As the load and the internal heater are heated, the bimetal deforms and the switch is opened. The cycling contact closes, due to spring forces, after the bimetal has cooled sufficiently to allow it to deform back to its original ambient temperature shape. An infinite switch energy regulator is typically employed in a 240 volt ac application and the internal heater and collaboration are configured for use in such an application.

One of the problems with the presently available energy regulator, which uses only 240 volt ac, is that the load exhibits much greater changes in instantaneous temperature as the infinite switch energy regulator cycles on and off. To a household user, this means that certain foods, such as chocolates and sauces, tend to burn in a 240 volt ac system due to the instantaneous changes in temperature.

In certain high-end ranges, a toggle switch is provided on the front panel of the electric range to select between 120 volts ac and 240 volts ac. The separate toggle switch is electrically connected to the infinite switch energy regulator, which is separately controlled by a user. By switching to a 120 volt ac mode using the toggle switch, the infinite switch energy regulator in these high-end ranges can provide a very gentle simmer. The toggle switch feeds the 120 volt ac to the infinite switch energy regulator. The infinite switch used in such high-end ranges is normally used in 240 volt ac applications. Hence, when the voltage is dropped to half of its design value, (i.e., 120 volt ac), both the internal and external heaters and resistive load are now supplied with one-fourth (¼) of the original power. As the internal heater causes the bimetal to deform, which is the prime mover for the cycling of energy regulating contacts, then at 120 volt ac it takes more time to deform the bimetal to a given geometry than at 240 volt ac. The amount of deformation is critical to the operation of an infinite switch because the internal components reposition themselves to the point where the contacts, and hence the circuit open, within the infinite control, thereby cycling the current.

As stated earlier, an infinite control's cycling contact closes, typically due to spring forces, after the bimetal has cooled sufficiently to allow it to deform back to its original ambient temperature shape. The time it takes for the bimetal to cool does not change significantly whether 120 volt ac or 240 volt ac is supplied to the infinite switch energy regulator. When power is no longer applied, and since the bimetal mechanism has reached the same physical state at 120 volt ac as at 240 volt ac (although taking more time to do so), the rate of energy dissipation is dictated by the thermal properties of the materials and surroundings. These parameters are not affected by a voltage which is no longer being applied, so that voltage is the only variable that changes.

Since the high-end ranges apply power for a longer period than normal in 120 volt ac mode than in 240 volt ac mode, with a cooling time remaining roughly constant, the duty cycle increases by a factor of four when the voltage is decreased to one-half. The effect to a substantial mass, such as a gallon of water, is negligible, because over a large period of time (e.g., an hour), the pot of water reaches the same steady state temperature whether the system utilized 120 volt ac or 240 volt ac in the manner described above. The reason for this is that although only one-fourth the power is being applied, it is being applied for four times the effective duty cycle, so that in effect, the total amount of energy being transferred to the physical mass remains constant. However, if a mass of non-substantial quantity is placed in physical contact with a thermal/electrical load, then a significant change in performance occurs. Although the steady state or average temperature theoretically remains constant, the instantaneous temperature changes exhibit a very noticeable difference when switching between 120 volt ac and 240 volt ac modes. The physical mass undergoes very slight temperature changes when in the 120 volt ac mode. Hence, by toggling to a 120 volt ac mode, a very gentle simmer of delicate foods, such as chocolates and sauces, may be achieved.

SUMMARY OF THE INVENTION

There is a need for a combined selector switch and infinite switch energy regulator that provides a single actuation mechanism for a user, thereby avoiding the increased space on the range top required by the use of a separate toggle switch and a separate infinite switch energy regulator actuator, and improving the intuitive control of the infinite switch at different voltages.

These and other needs are met by embodiments of the present invention which provide a selector switch and infinite switch energy regulator unit comprising an infinite switch energy regulator for adapting an input voltage level to an average output level. The energy regulator has a rotatable shaft for adjusting the average output voltage level. The unit also comprises an input voltage selector for selecting between a plurality of input voltages by actuation of a rotatable mechanism. The input voltage selector has as an output the input voltage level to the energy regulator. The rotatable shaft is also operatively coupled to the rotatable mechanism of the input voltage selector.

The present invention thus provides a selector switch and infinite switch energy regulator unit that employs the same rotatable shaft for selecting the input voltage level to the energy regulator, as well as for controlling the average output voltage level of the infinite switch energy regulator. This combined unit reduces the space required on the range, as well as providing a more intuitive control for the user of the range, since a separate toggle switch does not have to be separately operated to provide the functionality of a gentle simmering. Further, installation is eased, since the unit is already pre-assembled so that additional wiring between the toggle switch and the infinite switch after installation is avoidable.

The earlier stated needs are also met by another embodiment of the present invention which provides a voltage selector switch and infinite switch combination, comprising a voltage selector switch rotatably controlled to selectively provide as an output a first input voltage or a second input voltage. The combination also comprises an infinite switch mechanically and electrically coupled to the voltage selector switch, with an input connected to the output of voltage selector switch. The infinite switch provides a duty cycle that is rotatably controlled and is further dependent on the output of the voltage selector switch provided as an input to the infinite switch. A single rotatable shaft is coupled to the voltage selector switch and the infinite switch for rotatably controlling the selector switch and the infinite switch.

The foregoing and other features, aspects and advantages of the present invention will become more apparent from the following detailed description of the present invention when taken in conjunction with the accompanying drawings.

DETAILED DESCRIPTION OF THE INVENTION

The present invention addresses and solves problems related to the controlling of a resistive load in a manner that produces a gentler cycling of the voltages applied to the load, reducing the instantaneous voltage spikes typically applied to a load by an infinite switch energy regulator that is supplied with a single operating voltage. This is achieved by the use of a combination voltage selector switch and infinite switch energy regulator unit, which are both controlled by a single, common actuator. The commonly actuated selector switch and infinite switch energy regulator combination unit provides a more intuitive control to an end user, while reducing the amount of switches and installation space required on a panel of an electric range.

Figure 1:
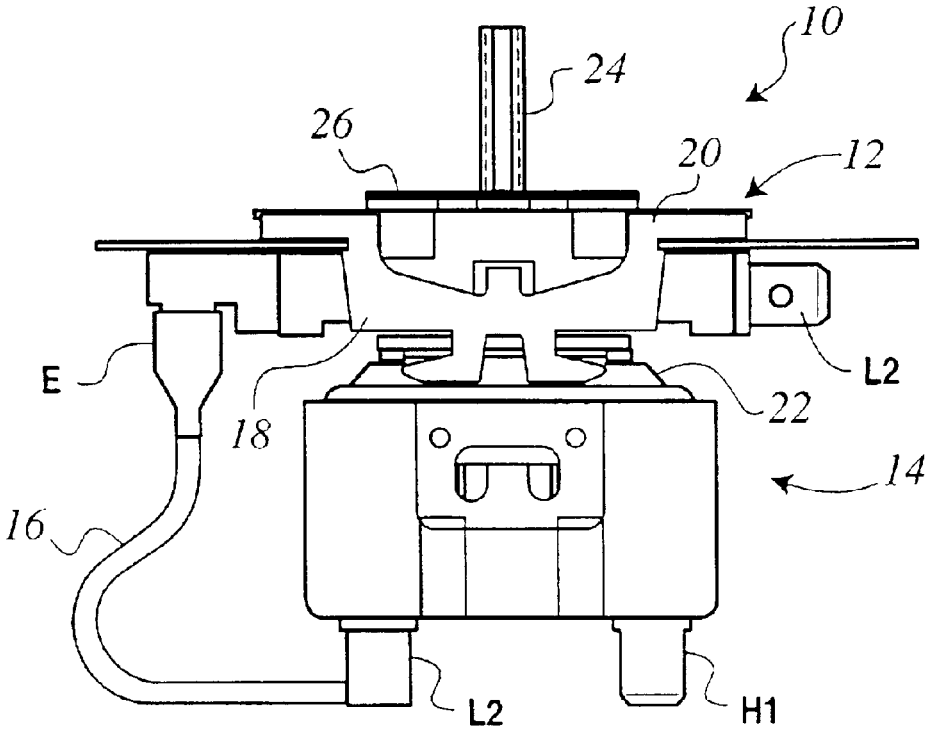
FIG. 1 depicts a side view of an assembled unit having a selector switch and infinite switch energy regulator in accordance with embodiments of the present invention.

FIG. 1 depicts a side view of an assembled combination unit in accordance with certain embodiments of the present invention. The unit 10 comprises two main switches: a selector switch 12 and an infinite switch 14. The selector switch 12 may operate in the manner of a substantially conventional F-switch to receive inputs of two different voltages and provides as an output one of the two input voltages. Hence, the selector switch 12 may be considered an input voltage selector.

The selector switch 12 is mechanically attached and electrically coupled to the infinite switch 14, also referred to as an infinite switch energy regulator. The infinite switch 14 may operate in a relatively conventional manner, by adapting an input voltage level to an average output voltage level by changing the duty cycle in a controlled manner.

The unit 10 receives a plurality of input voltages at the selector switch 12, and specifically at the inputs L2 and N. Only input L2 is seen in the side view of FIG. 1. The unit 10 is not shown connected to any power sources in FIG. 1. The output E of the selector switch 12 is connected by a jumper cable 16 to an L2 input of the infinite switch 14. In addition to the L2 input, the infinite switch 14 also has an L1 input (not shown in FIG. 1), and output terminals P, H1 and H2. A pilot light is connected between the P output and the L2 input of the selector switch 12 to indicate operation of the burner by the unit 10. The infinite switch 14 also includes output terminals H1 and H2 (not shown in FIG. 1), that are to be coupled to a load, such as a resistive heating element of an electric range.

In this embodiment, the infinite switch 14 is of the parallel type, whereby the internal heater in the infinite switch 14 is electrically parallel with a load being controlled, typically on an electric range cooktop, and typically a purely resistive load. However, the present invention does not require that a parallel type infinite switch be used. The infinite switch 14 could also utilize an electrical series type control that is known to those of ordinary skill in the art, such as the internal electric heater, which causes the cycling of internal contacts by heating bimetallic material, is in series with the load being controlled, in the same fashion as the parallel type control in this illustrative example.

The subassembly of the selector switch 12 and the subassembly of the infinite switch 14 are mechanically joined by the mechanical fastening of protrusions 18 and top cover 20 of the selector switch 12 with corresponding geometry in the top cover 22 of the infinite switch 14. This joining serves primarily to prevent the selector switch subassembly 12 from rotating or translating with respect to the infinite switch subassembly 14. The alignment of the fastening also ensures that the actuating rotatable shaft does not bind with the cam, as will be described.

As seen in FIG. 1, a single rotatable shaft 24 extends from the unit 10, and more particularly, from the selector 12. The rotatable shaft 24 is a single shaft that commonly operates the selector switch 12 and the infinite switch 14. Hence, the rotatable shaft 24 provides a single user interface to operate both switching systems. This has the advantage of saving space on the electric range cooktop, and provides a more intuitive and easier to use switching arrangement for an end user.

Figure 2:
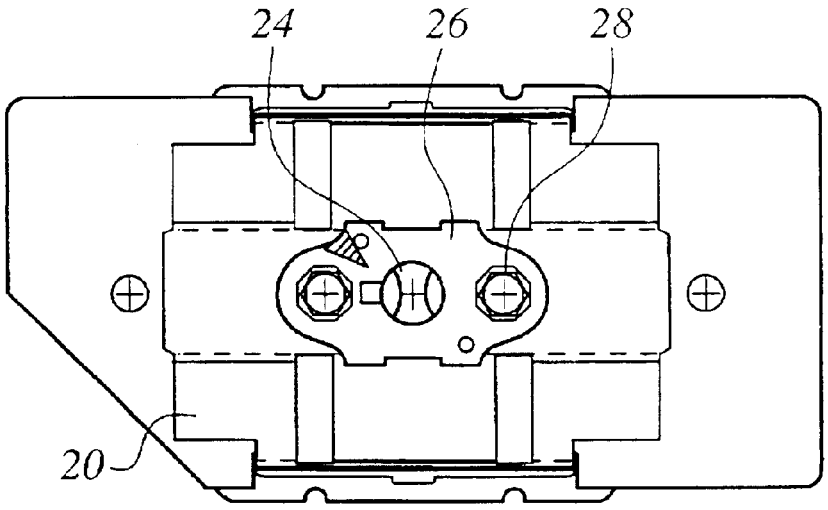
FIG. 2 shows a top view of the unit of FIG. 1.

A top view of the assembled unit is depicted in FIG. 2, and better illustrates the top cover 20 of the selector switch 12. The top cover 20 includes a face plate 26 with two threaded openings 28 that provide for the connection of the unit 10 to a range front panel. It is noted that the unit 10 is assembled in such a way that the selector switch 12 has a longest dimension that will easily mount vertically with respect to a front panel on an electric range. In this manner, other larger controls can be placed side-by-side onto the range front panel without interfering with one another. The spacer plate 26 accommodates the curvature on the front panels of many electric ranges which tend to bow concavely with respect to the vertical direction as seen by the control, under a condition where the vertical access for direction is defined by the line of gravity. In certain versions of the infinite switches as presently available, certain components are known to function differently under the influence of gravity. The infinite switch 14 used for the depicted embodiment may have orientation sensitivity, which is readily accommodated by the depicted design. Also, the spacer plate 26 prevents the front panel of an electric range, which is typically curved, from being straightened or undesirably flexed in such a way as to damage its aesthetic and functional properties. In certain embodiments of the present invention, the top cover 20 of the selector switch 12 may be provided with an electrical insulator plate between the top cover 20 and the terminals of the selector switch 12 to ensure that no electrical arc occurs between the unit 10 and the front panel of the electric range, with which the end user often comes into contact. This electrical insulator plate is not depicted in the drawings.

Figure 3:
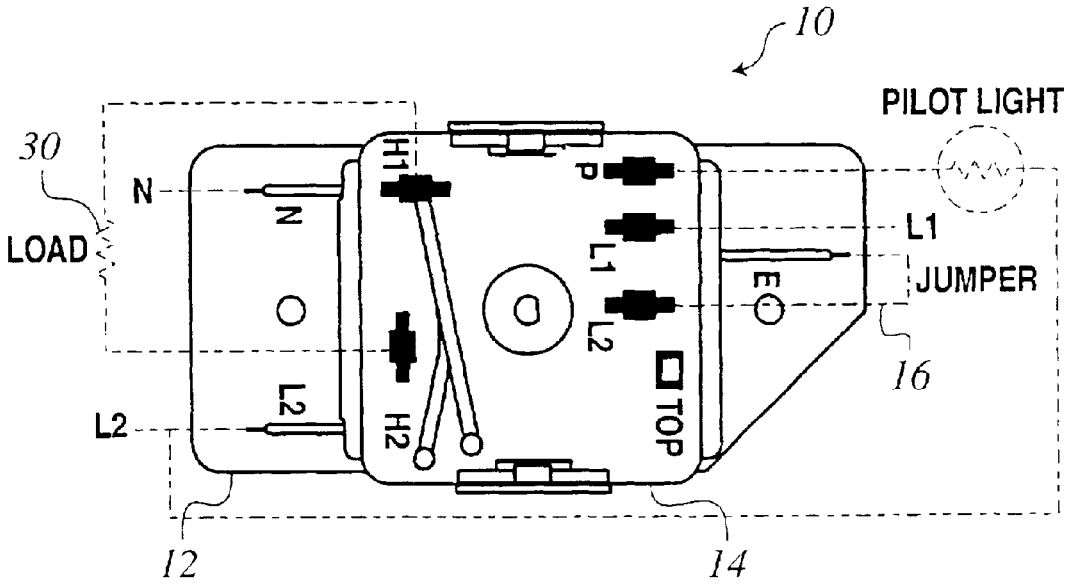
FIG. 3 depicts a bottom view of the unit of FIG. 1.
Figure 4:
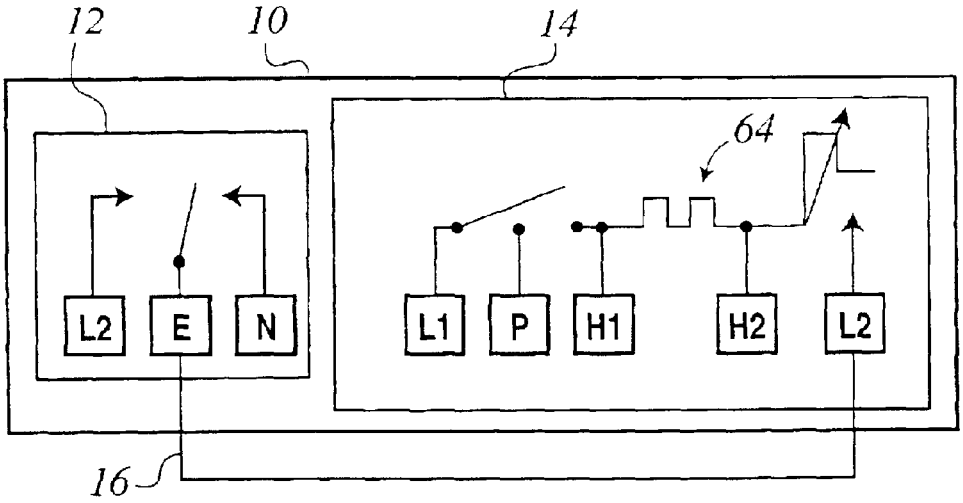
FIG. 4 is an electrical schematic diagram of the unit of FIG. 1.

FIG. 3 depicts the bottom view of the unit 10 and also schematically shows the connections made between the specific terminals of the unit 10. In particular, the N and L2 inputs of the selector switch 12 are to be attached to power to receive the 120 volt ac and 240 volt ac voltages. The output E of the selector switch 12 is connected by the jumper cable 16 to the input L2 of the infinite switch 14. The other input L1 of the infinite switch 14 is connected to the voltage source, as indicated by the reference L1. The terminal P on the infinite switch 14 is connected in series with the pilot light and the input voltage L2, as depicted in FIG. 3. Finally, the load 30, which may be a resistive heating element, for example, is coupled to the output terminals H1, H2 of the infinite switch 14. The internal schematic diagram of the unit 10, depicting these connections, is provided in FIG. 4.

As can be appreciated by this wiring in the schematic diagram, the selector switch 12 receives first and second input voltages and may be switched between these two voltages (e.g., 120 volt ac and 240 volt ac). The jumper cable 16 extends from the E output terminal of the selector switch 12 to the L2 input of the infinite switch 14. H1 and H2 terminals are depicted as being connected to the bimetal heater. When the infinite switch closes so that the L1 contact and the L2 contact is made, the bimetal material is heated (the on part of the duty cycle) until the bimetal is deformed by a specified amount and the contact is broken.

The input to the L2 terminal of the infinite switch 14 may be switched between 120 volt ac and 240 volt ac by the selector switch 12 toggling between the N input and the L2 input. This has the effect of controlling the input voltage to the infinite switch 14 and changing the duty cycle in dependence upon the input voltage. Hence, a more gentle simmering may be provided, as described earlier. The 120 volt ac input voltage causes the bimetal to be deformed to a given geometry at a slower rate than when the input voltage is at a 240 volt ac. However, the cooling of the bimetal does not change significantly in dependence on the voltage. Thus, the duty cycle, defined as the on time divided by the on time plus the off time increases by a factor of four when the voltage is decreased to one-half. Although the steady state or average temperature theoretically remains constant, instantaneous temperature changes exhibit a very noticeable difference when switching between 120 volt ac and 240 volt ac. The physical mass of a material being heated undergoes very slight temperature changes when in the 120 volt ac mode, providing a gentle simmering.

Figure 5:
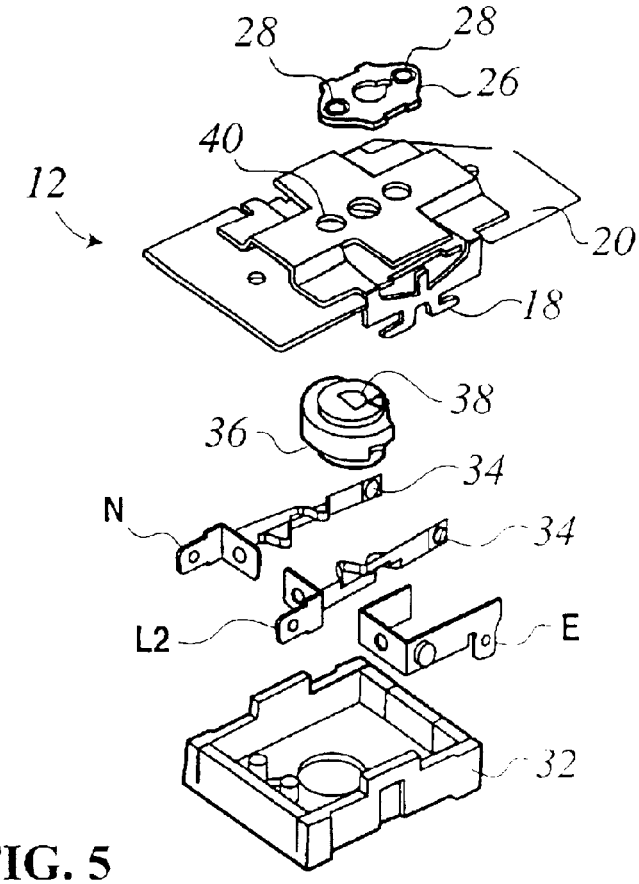
FIG. 5 shows a fully exploded view of a selector switch constructed in accordance with embodiments of the present invention.

FIG. 5 depicts a fully exploded view of a selector switch 12 in accordance with an exemplary embodiment of the present invention. The selector switch 12, which may also be referred to as an F switch, as is known in the art, has a bottom housing 32 that receives input terminals N and L2, as well as output terminal E. The input terminals N, L2 include terminal contacts 34 that selectively make contact with the output terminal E.

Figure 6:
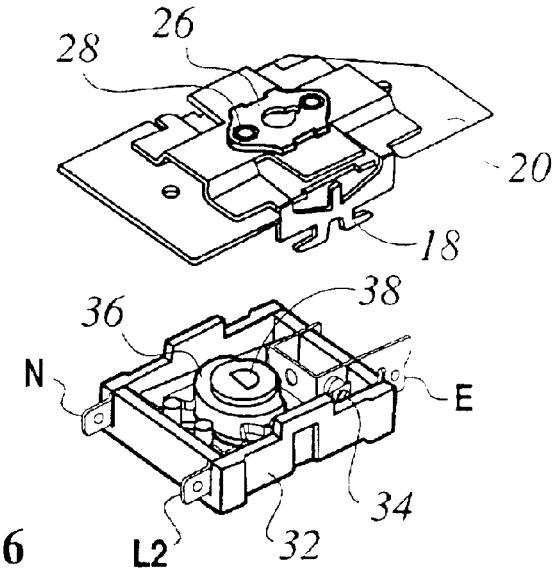
FIG. 6 shows a partially exploded view of the selector switch of FIG. 5.

The selector switch 12 includes a rotatable cam 36 that is mounted on the rotatable shaft 24 (not shown in FIG. 5) through an opening 38. The rotation of the cam 36 causes either the N input terminal of the L2 input terminal to make contact with the output terminal E. The top cover 20 with protrusions 18 is assembled on to the housing 32. This spacer plate 26, through which the shaft 24 also extends, will be attached by screws or other fasteners to the range and to the selector switch 12 by apertures 40 in the top cover 20. A partially exploded view of the selector switch 12 is depicted in FIG. 6. In this case, the cam 36 and the terminals N, L2 and E are provided in housing 32, and the top cover 20 already has the spacer plate 26 attached, by an adhesive, for example.

Figure 7:
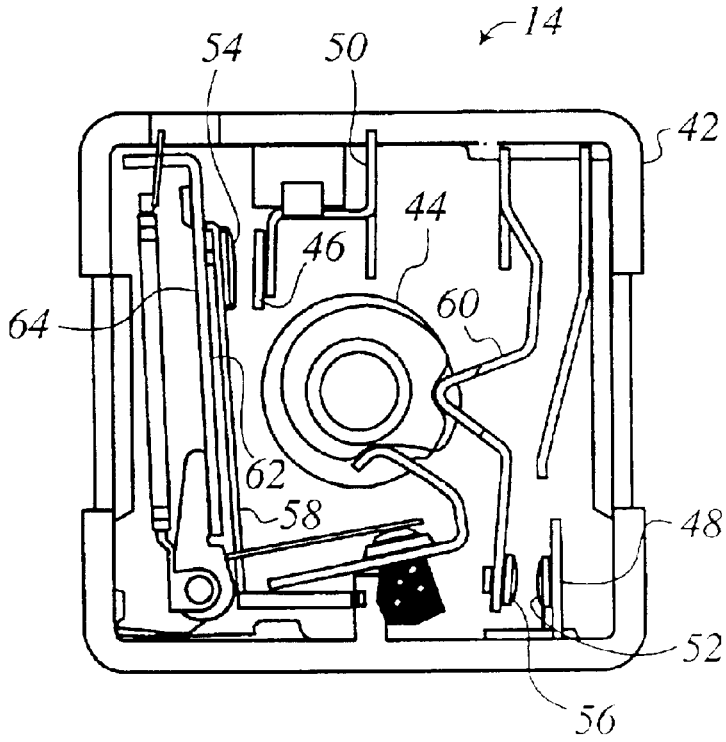
FIG. 7 shows a plan view of an infinite switch with the cover removed, in accordance with embodiments of the present invention.

FIG. 7 depicts a plan view of an infinite switch with a cover removed, in accordance with embodiments of the present invention. This infinite switch 14 is generally constructed to operate in a manner of conventional infinite switches. Inside the infinite switch housing 42, a cam 44 is provided. The rotatable shaft 24 extends through the center of the cam 44, although the rotatable shaft is not depicted in FIG. 7. The infinite switch 14 has fixed electrical contacts 46, 48 carried by terminals 50, 52. Terminal 50 is connected to input terminal L1, while terminal 52 is connected to input terminal L2 on the infinite switch 14. Movable contacts 54, 56 are carried by movable switch blades 58, 60. The switch blades 58, 60 are interconnected to terminals HI and H2. When the movable contacts 54, 56 are placed against the fixed contacts 46, 58 by the switch blades 58, 60, electrical current passes through the load 30, since the load 30 is placed across the power source leads L1 and L2 by the closed switches of the infinite switch 14. The cam 44 controls the movement of the switch blades 58, 60 and it is itself controlled by the rotation of the rotatable shaft 24. The shape of the cam 44 controls the duty cycle of the infinite switch 14, as is well known to those of ordinary skill in the art.

The switch blade 58 includes a bimetal member 62 and a heater 64 arranged so that electrical current is adapted to flow through the electrical heater 64 whenever the movable contact 54 is disposed against the fixed contact 46. This heats the bimetal member 62 which tends to warp and move the movable contact 54 away from the fixed contact 46. This causes electrical current through the electrical heater 64 to be terminated so that the bimetal member 62 is allowed to cool and place movable contact 54 back into contact with the fixed contact 46. In this manner, the infinite switch 14 cycles between its closed and open positions as long as the actuating shaft 24 sets the cam in any on position of the infinite switch.

Figure 8:
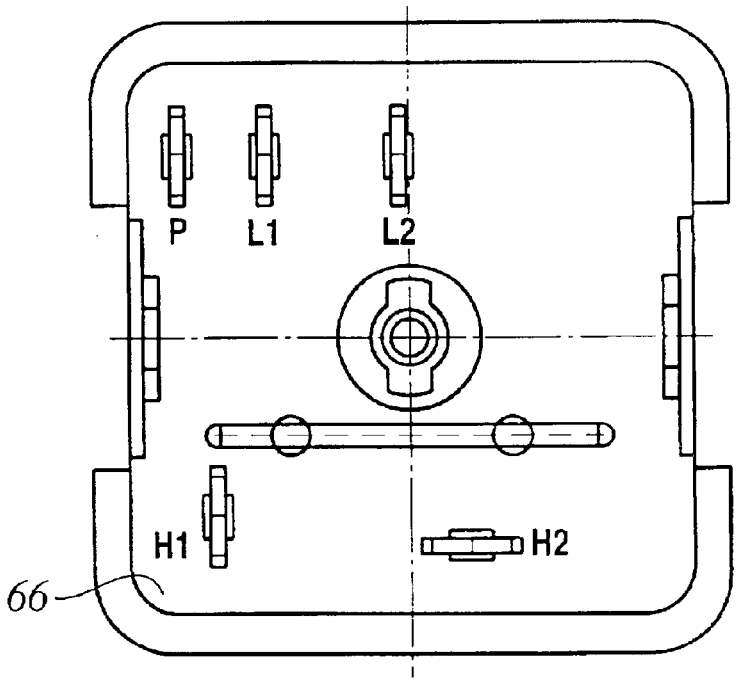
FIG. 8 shows a bottom plate of the infinite switch of FIG. 7.

The bottom plate 66 of the infinite switch 14 is depicted in FIG. 8, and illustrates the terminals L1, L2, P, H1 and H2 that extend therefrom.

Figure 9:
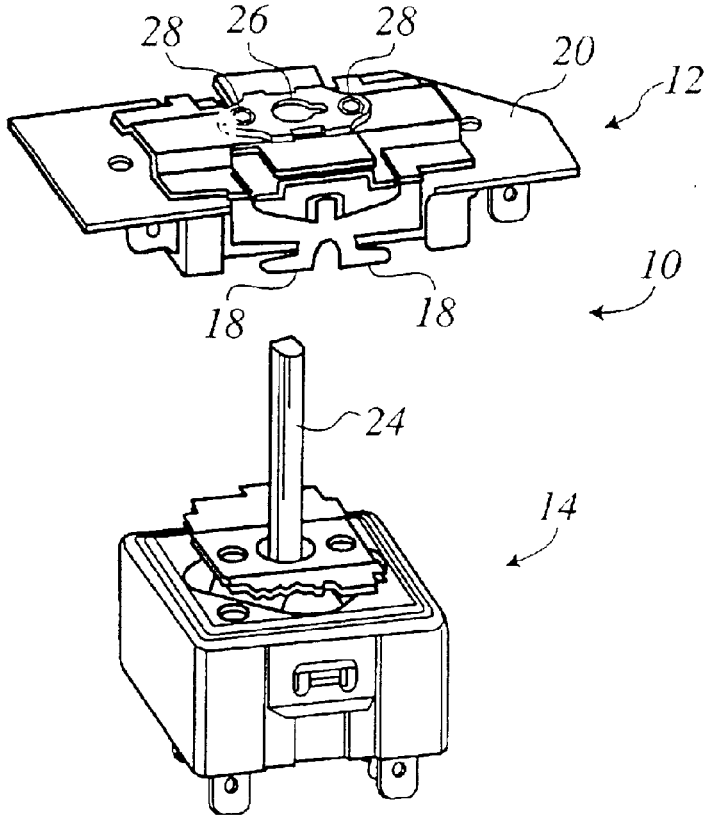
FIG. 9 shows a perspective view of the unit in a pre-assembled position.
Figure 10:
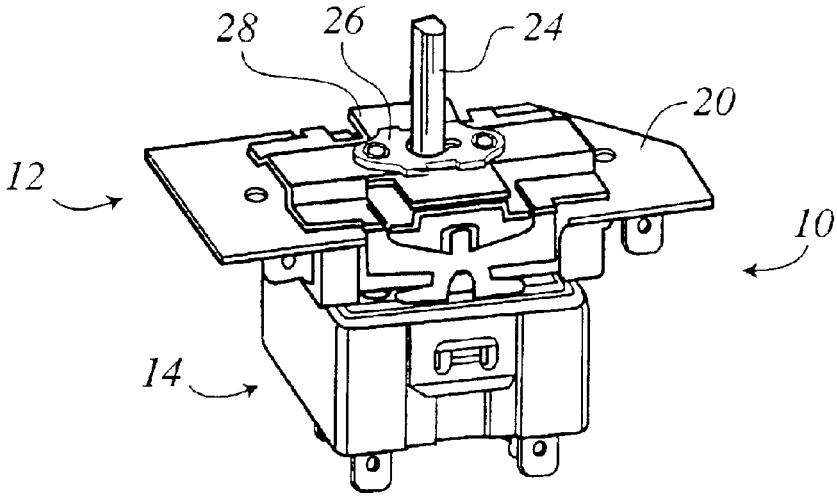
FIG. 10 is a perspective view of the assembled unit in accordance with embodiments of the present invention.

FIG. 9 depicts the selector switch 12 and infinite switch 14 prior to assembly of the two subassemblies together. As illustrated in FIG. 9, the rotatable shaft 24 is already installed in the infinite switch 14 through the cam 44. Assembly involves the snap fitting of the selector switch 12, through the protrusions 14, onto the infinite switch 12. The final assembled unit is depicted in FIG. 10, and is shown in perspective view.

Although physically joined by the mechanical fastening provided by the protrusions 18, the extension of the rotatable shaft 24 from the infinite switch 12 through the rotatable cam 36 of the selector switch 12 allows for the two switches 12, 14 to physically act as a single device or unit 10. The rotatable shaft 24 has a cross-sectional shape which mates with the cross-sectional shape of the opening 38 in the rotatable cam 36 of the selector switch 12. Both the opening 38 and the cam 36 and the rotatable shaft 24 share a common axis. The rotatable shaft 24 can therefore slide in and out of the rotatable cam 36 as long as the two cross-sections have mated effectively. The proper sliding of these components is important for the ease of assembly of these two switch units 12, 14 into a single unit 10.

Due to imposed agency regulations, the infinite switch 14 must have a child safety related two-motion actuation in order to operate. The infinite switch 14 incorporates this function by having a "push-to-turn" mechanism internal to its design. In order to maintain design simplicity, low cost, and easy manufacturing, the selector switch 12 does not have, nor does it require, a separate "push-to-turn" mechanism. Instead, the present unit 10 allows the rotatable shaft 24 to slide relative to the cam opening 38 in the rotatable cam 36 of the selector switch 12 during normal operation as well as during assembly. In this configuration, the selector switch 12 allows the "push-to-turn" mechanism to operate as required. Close alignment of the two portions is generally needed to overcome a potential for binding of the rotatable shaft 24 with the cam opening 38 in the rotatable cam 36 of the selector switch 12.

Figure 11:
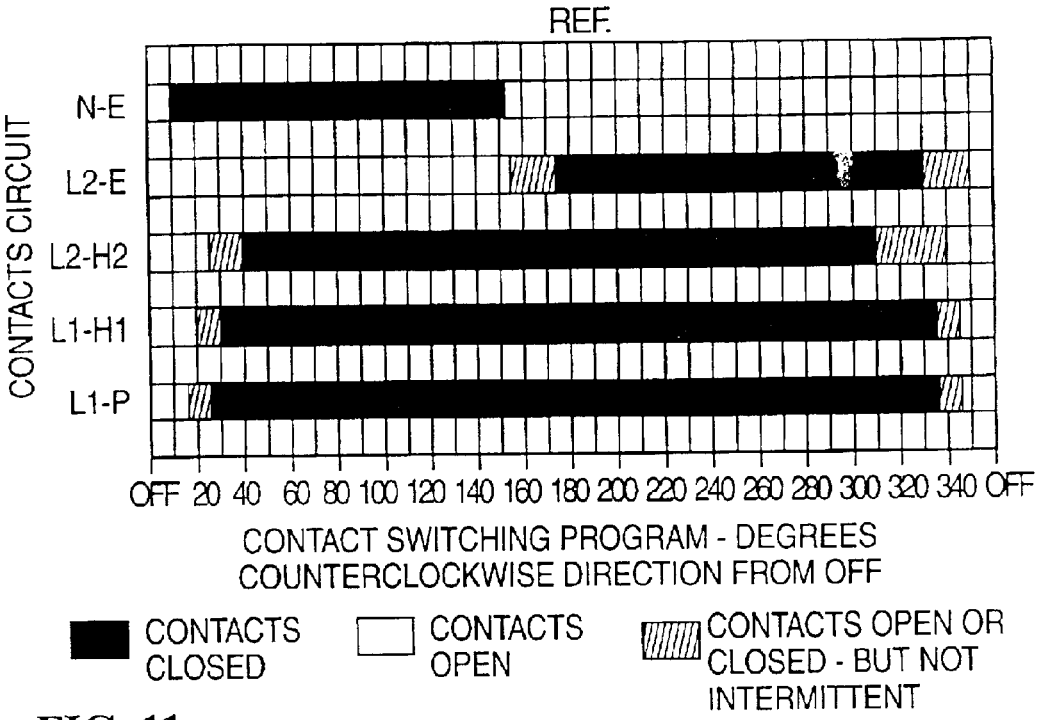
FIG. 11 shows an exemplary contact switch program of the combination unit in accordance with embodiments of the present invention.
Figure 12:
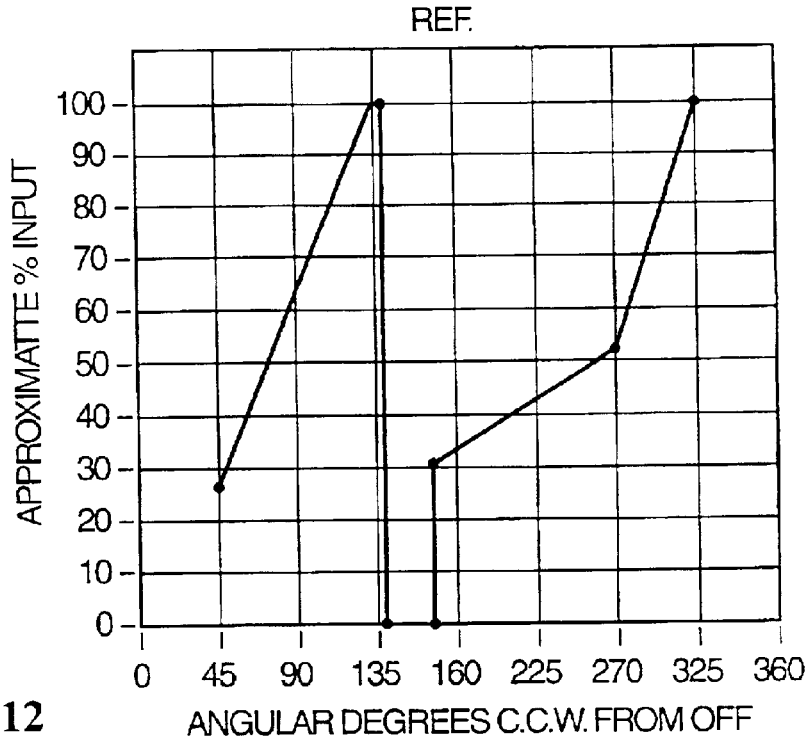
FIG. 12 is a graph showing an exemplary duty cycle for the combination unit constructed in accordance with embodiments of the present invention.

In operation, the unit 10 can be operated from the off position in either a clockwise or counter-clockwise direction, after defeating the push-to-turn lock mechanism. The rotatable cam 36 of the selector switch 12 is designed in such a manner that the N-E circuit on the selector switch 12, which inputs 120 volt ac disclosed for approximately 130° such that it utilizes the full duty cycle spectrum available from the infinite switch 14 when functioning at one-fourth power. Reference should be made to FIGS. 11 and 12. FIG. 11 shows the contact switching program, while FIG. 12 depicts an exemplary duty cycle graph. The full spectrum of duty cycle is the minimum consistent percentage on-time.

The unit 10, according to certain embodiments of the present invention, has a physical dwell or rotational delay in operation of the rotatable cam 36 in the selector switch 12. The dwell can be seen in FIGS. 11 and 12. In this dwell, the selector switch 12 is opened in both of the potential circuits. This dwell in the rotatable cam 36, is for example, but not by way of limitation, approximately 20° in physical rotation of the shaft 24. One purpose of the dwell is to ensure that an arc will not jump from the line voltage to the neutral line in the home electrical circuit. If such an arc-over were to occur across terminals L2 and N on the selector switch 12, then the circuit breaker will likely trip in the home. The amount of dwell needed in the rotatable cam 36 is a function of the amount of time it takes for an arc to self-extinguish versus the maximum speed that an operator could rotate the shaft 24 through the dwell so as to open one set of contacts and then close the other set of contacts. A potential range for the dwell angle may be between 10° to about 40°, with approximately 20° being preferred in the illustrated embodiment.

One of the advantages of the configuration of the unit in accordance with embodiments of the present invention is the ease of assembly provided. The jumper cable 16 is placed between terminals that are provided on the same side of the unit 10 so that minimum length jumper cables 16 may be employed. Also, by assuring that the input terminals of the unit (which are found on the selector switch 12) are on an opposing side of the unit 10, installation into the electric range is also simplified, preventing mis-wirings. Color coding of the terminals may be employed such that the jumper cable 16 will be connected to the proper terminal. For example, in certain embodiments of the invention the terminal L2 of the infinite switch 14, made of brass, is not plated over such that its natural color is observed during assembly as a color code, compared to all of the other terminals on the infinite switch 14, which are tin plated and thus appear silver in color. This facilitates visual error checking and proper assembly.

The present invention as described above provides a combination unit that exhibits ease of assembly, safety in performance by preventing arc-over, provides ease of use for an end user through a single actuation mechanism, and produces a plurality of simmer voltages through the combination of a selector switch and an infinite switch.

Although the present invention has been described and illustrated in detail, it is to be clearly understood that the same is by way of illustration and example only and is not to be taken by way of limitation, the scope of the present invention being limited only by the terms of the appended claims.

What is claimed is:

1. A selection switch and infinite switch energy regulator unit, comprising:

an infinite switch energy regulator for adapting an input voltage level to an average output voltage level, the energy regulator having a rotatable shaft for adjusting the average output voltage level; and an input voltage selector for selecting between a plurality of input voltages by actuation of a rotatable mechanism, and having as an output the input voltage level to the energy regulator, the rotatable shaft operatively coupled to the rotatable mechanism.

2. The unit of claim 1, wherein the rotatable mechanism has an aperture, the rotatable shaft extending through the aperture in sliding engagement therewith.

3. The unit of claim 2, wherein the aperture has an interior shape that corresponds to a cross-sectional shape of the rotatable shaft such that the rotatable mechanism is rotated with the rotatable shaft.

4. A selection switch and infinite switch energy regulator unit, comprising:

an infinite switch energy regulator for adapting an input voltage level to an average output voltage level, the energy regulator having a rotatable shaft for adjusting the average output voltage level;

an input voltage selector for selecting between a plurality of input voltages by actuation of a rotatable mechanism, and having as an output the input voltage level to the energy regulator, the rotatable shaft operatively coupled to the rotatable mechanism; and wherein the energy regulator provides a variable duty cycle in response to rotation of the rotatable shaft.

5. The unit of claim 4, wherein a maximum duty cycle corresponding to a maximum average output voltage level is provided by the energy regulator, and wherein the input voltage selector toggles to a higher input voltage level from a lower input voltage level at a shaft angle of the rotatable shaft corresponding to the maximum duty cycle of the energy regulator at the lower input voltage level.

6. The unit of claim 5, wherein the rotatable mechanism has contacts for the lower input voltage level and contacts for the higher input voltage level and a dead-time dwell angle between switching from the lower input voltage level, to the higher input voltage level such that the contacts for the higher input voltage level are prevented from closing for at least a predetermined time after the contacts for the lower input voltage level are opened.

7. The unit of claim 6, further comprising a jumper wire electrically connecting the output of the input voltage selector to a first input of the energy regulator.

8. The unit of claim 7, wherein the first input of the energy regulator is an L2 input.

9. The unit of claim 8, further comprising a face plate bracket on the input voltage selector and a threaded plate on the face plate bracket, the threaded plate including mounting threads for mounting the unit.

10. The unit of claim 9, wherein the input voltage selection includes: first and second sides; first and second inputs on the first side; and the output on the second side.

11. The unit of claim 10, wherein the energy regulator has first and second outputs on a first side, first and second inputs on a second side, the output of the input voltage selector being on the same side as the inputs of the energy regulator.

12. The unit of claim 11, wherein the input voltage selector is an F-switch.

13. The unit of claim 12, wherein the plurality of input voltages includes 120 volt and 240 volt.

14. The unit of claim 13, wherein the dead-time dwell angle is between about 10° to about 40°.

15. The unit of claim 13, wherein the dead-time dwell angle is about 20°.

16. A voltage selector switch and infinite switch combination, comprising:

a voltage selector switch rotatably controlled to selectively provide as an output a first input voltage or a second input voltage;

an infinite switch mechanically and electrically coupled to the voltage selector switch, with an input connected to the output of the voltage selector switch, and providing a duty cycle that is rotatably controlled and is further dependent on the output of the voltage selector switch provided as an input to the infinite switch; and a single rotatable shaft coupled to the voltage selector switch and the infinite switch for rotatably controlling the selector switch and the infinite switch.

17. A voltage selector switch and infinite switch combination, comprising:

a voltage selector switch rotatably controlled to selectively provide as an output a first input voltage or a second input voltage;

an infinite switch mechanically and electrically coupled to the voltage selector switch, with an input connected to the output of the voltage selector switch, and providing a duty cycle that is rotatably controlled and is further dependent on the output of the voltage selector switch provided as an input to the infinite switch;

a single rotatable shaft coupled to the voltage selector switch and the infinite switch for rotatably controlling the selector switch and the infinite switch; and wherein the voltage selector switch is configured to receive 120 volt as the first input voltage and 240 volt as the second input voltage, with the duty cycle provided by the infinite switch changing in response to switching between the first and second input voltages.

18. The combination of claim 17, wherein the selector switch has a cam with a pre-defined dwell between the first and second input voltages that ensures an electrical arc produced by opening contacts in the selector switch for the first input voltage is extinguished before contacts in the selector switch for the second input voltage make.

19. The combination of claim 18, wherein the pre-defined dwell is between about 10° to about 40°.

20. The combination of claim 18, wherein the pre-defined dwell is about 20°.

* * * * *